US010882544B2

(12) United States Patent
Adomeit et al.

(10) Patent No.: US 10,882,544 B2
(45) Date of Patent: Jan. 5, 2021

(54) SAFETY METHOD FOR A RAILWAY NETWORK

(71) Applicant: SIEMENS MOBILITY GMBH, Munich (DE)

(72) Inventors: Sven Adomeit, Braunschweig (DE); Uwe Deichmann, Wolfenbuettel (DE); Norbert Geduhn, Uetze (DE); Carlos Del Pozo, Cremlingen (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 15/764,891

(22) PCT Filed: Sep. 7, 2016

(86) PCT No.: PCT/EP2016/071047
§ 371 (c)(1),
(2) Date: Mar. 30, 2018

(87) PCT Pub. No.: WO2017/055037
PCT Pub. Date: Apr. 6, 2017

(65) Prior Publication Data

US 2018/0273065 A1 Sep. 27, 2018

(30) Foreign Application Priority Data

Sep. 30, 2015 (DE) ..... 10 2015 218 971

(51) Int. Cl.
*B61L 27/00* (2006.01)
*B61L 3/00* (2006.01)

(52) U.S. Cl.
CPC ..... *B61L 27/0038* (2013.01); *B61L 3/006* (2013.01); *B61L 3/008* (2013.01)

(58) Field of Classification Search
CPC ..... B60L 27/0038; B61L 3/006; B61L 3/008; B61L 27/0038
(Continued)

(56) References Cited

U.S. PATENT DOCUMENTS 7,089,093 B2 8/2006 Lacote et al.
8,521,346 B2 8/2013 Haaf
(Continued)

FOREIGN PATENT DOCUMENTS

CN 1163592 A 10/1997
CN 101480962 A 7/2009
(Continued)

OTHER PUBLICATIONS

Eichenberger, Peter.: "Kapazitätssteigerung durch ETCS"; Signal + Draht; Telzlaff Verlag GmbH; Eisenbahntechnische Fachzeitschrift für Information and Kommunikation; Darmstadt; vol. 99; No. 3; pp. 6-14; ISSN: 0037-4997; XP001504566; 2007.

*Primary Examiner* — Yazan A Soofi
(74) *Attorney, Agent, or Firm* — Laurence Greenberg Werner Stemer; Ralph Locher

(57) ABSTRACT

A protection method for a railway network, which is divided into section segments by section elements and can be traveled upon by vehicles. In order to optimize the vehicle sequence in the railway network, different train sequence point types are specified and different braking curves of the same braking curve type are provided by the vehicles. Each of the different braking curves of the same braking curve type of the particular vehicle is associated with one of the different train sequence point types.

7 Claims, 14 Drawing Sheets

(58) Field of Classification Search
USPC ..... 701/20
See application file for complete search history.

(56) References Cited

U.S. PATENT DOCUMENTS

| | | | | |
|---|---|---|---|---|
| 2004/0267415 | A1 | 12/2004 | Lacote et al. | |
| 2010/0299007 | A1* | 11/2010 | Ghaly | B61L 3/008 701/20 |
| 2012/0065818 | A1 | 3/2012 | Haaf | |
| 2018/0319415 | A1* | 11/2018 | Adomeit | B61L 27/0011 |

FOREIGN PATENT DOCUMENTS

| | | | |
|---|---|---|---|
| CN | 102358336 | A | 2/2012 |
| DE | 1405716 | A1 | 3/1969 |
| DE | 4442196 | A1 | 5/1996 |
| DE | 602004000115 | T2 | 7/2006 |
| DE | 102009018616 | A1 | 10/2010 |
| EP | 1498338 | A1 | 1/2005 |

* cited by examiner

SAFETY METHOD FOR A RAILWAY NETWORK

BACKGROUND OF THE INVENTION

FIELD OF THE INVENTION

The invention relates to a protection method for a rail network, which is divided by track elements into track sections and on which vehicles can travel.

With a protection method known from practice according to which the European Train Control System (ETCS) operates, the vehicles receive movement authorities for headway points EOAs (ends of authorities), wherein they approach the headway points in each case with the same braking curve of a type of braking curve, namely the so-called "SBD curve to EOA". Simultaneously active are further braking curves of further braking curve types for the vehicles—for example the so-called "EBD curve to SL", but also an "SBI" and an "EBI". Herein, the one braking curve of the respective type of braking curve for each of the vehicles on which the vehicle headway (train headway) in the rail network depends is matched to the worst-case scenario.

SUMMARY OF THE INVENTION

The invention is based on the object of optimizing the headway in the rail network.

This object is achieved with a protection method as claimed, in that different headway point types are specified and that the vehicles provide different braking curves of the same type of braking curve, wherein each of the different braking curves of the same type of braking curve for the respective vehicle is in each case assigned to one of the different types of headway point.

Therefore, when approaching a headway point of one type of headway point, a vehicle activates a braking curve of one type of braking curve and, when approaching a further headway point of another type of headway point, another braking curve of the same type of braking curve. This makes it possible, when approaching the headway points—in accordance with the braking situation dependent upon the respective type of headway point—to brake at the latest possible time and increase the headway rail network overall.

The dependent claims relate to advantageous developments of the protection method according to the invention.

Accordingly, it is provided according to the teaching of a dependent claim that at least one braking target point, which is a danger point, forms a headway point of a first headway point type to which a first braking curve of the respective vehicle is assigned.

It is provided according to the teaching of a dependent claim that a track element embodied as a switching device specifies at least one braking target point, which is a danger point.

Furthermore, it is provided according to the teaching of a dependent claim that a track element embodied as a bumper specifies at least one braking target point, which is a danger point.

It is also provided according to the teaching of a dependent claim that, in a track section, with reference to the present position of a vehicle end of a stationary vehicle, at least one braking target point, which is a danger point, is specified for a following vehicle.

According to the teaching of a dependent claim, it is provided that at least one braking target point, which is not a danger point, forms a headway point of a second type of headway point to which a second braking curve of the respective vehicle is assigned.

According to the teaching of a dependent claim, it is provided that a track element embodied as spring-loaded switching device specifies at least one further braking target point, which is not a danger point.

Furthermore, according to the teaching of a dependent claim it is provided that, in a track section, with reference to the current position of a vehicle end of a moving vehicle, at least one further braking target point, which is not a danger point, is specified for a following vehicle.

It is also provided according to the teaching of a dependent claim that a track element embodied as a fictitious double entry/exit element specifies at least one braking target point, which is not a danger point.

BRIEF DESCRIPTION OF THE SEVERAL VIEWS OF THE DRAWING

The invention is described below in more detail with reference to the figures in which.

DESCRIPTION OF THE INVENTION

Figure 1A:
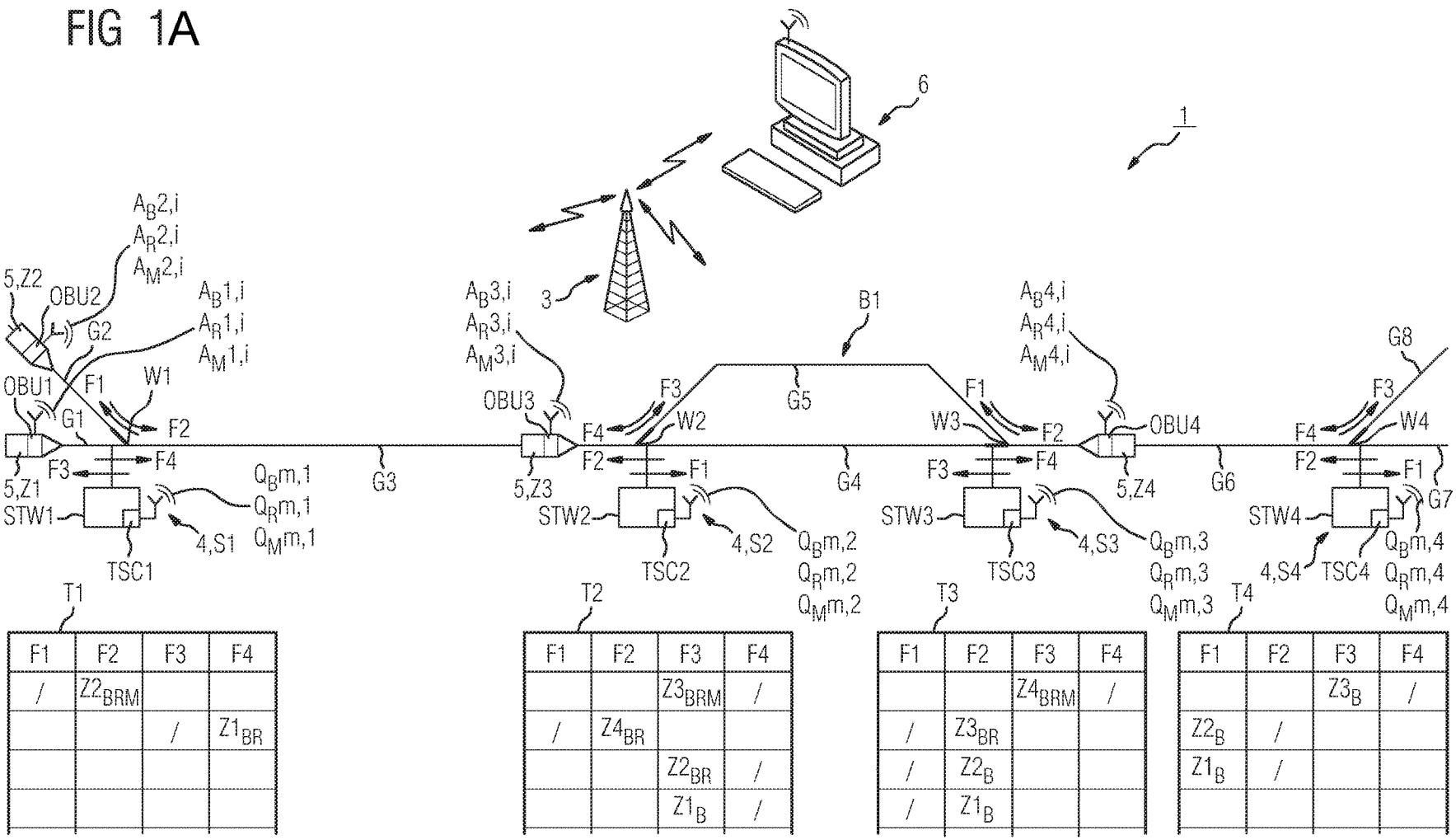
FIG. 1*a* shows a section of a rail network, which is divided by track elements into a plurality of track sections and on which vehicles can travel in dependence on data from components of a track atlas and which is equipped with a first embodiment of a protection system according to the invention, at a first time point.

FIG. 1 shows a section of a rail network 1 with a first embodiment of the protection system according to the invention 2. The protection system 2 comprises four subsystems 3 to 6.

A first one 3 of the subsystems is a communication system via which the three further subsystems 4 to 6 communicate with one another.

A second one 4 of the subsystems is formed by track elements S1, S2, . . . , Sp with track element controls TSC1, TSC2, . . . , TSCp, wherein the track elements divide the rail network 1 into a plurality of track sections G1, G2, . . . , Gq. The track elements include, for example, switching devices, track crossings, grade crossings for passengers, bumpers and derailment detectors. However, the track elements also include working zones established to be mobile. In the section shown, initially four track elements S1 to S4 link eight track sections G1 to G8. The four track elements S1 to S4 are each a switching device with a switch Wi, where i=1 to 4, and with an operating element STWi, where i=1 to 4, for the switch Wi.

A third one 5 of the subsystems is formed by vehicles Z1, Z2, . . . , Zr in the form of trains with vehicle controls OBU1, OBU2, . . . , OBUr. The section shown contains by way of example four vehicles Z1 to Z4.

The fourth subsystem 6 is formed by a control room OCC. The track element controls TSC1, TSC2, . . . , TSCp and the vehicle controls OBU1, OBU2, . . . , OBUr each comprise a secure computer—for example in the form of a 2v2 computer or a 2v3 computer. The control room OCC also comprises a computer, which can be embodied as a non-secure computer. The communication system 2 is preferably embodied as a wireless radio communication system.

Figure 11:
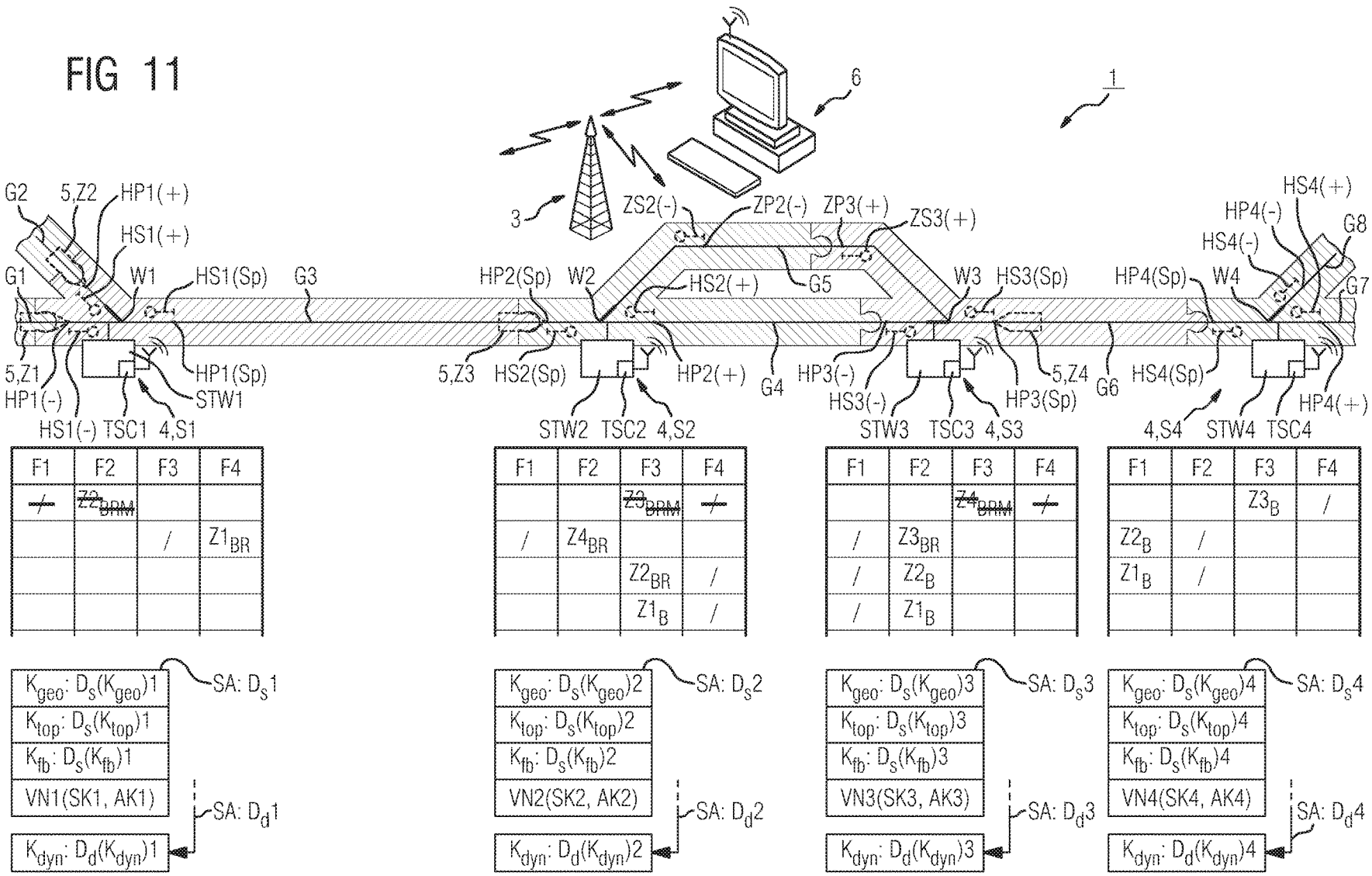
FIG. 11 shows the section of the rail network in FIG. 1*a* with a schematic representation of the track atlas.
Figure 12:
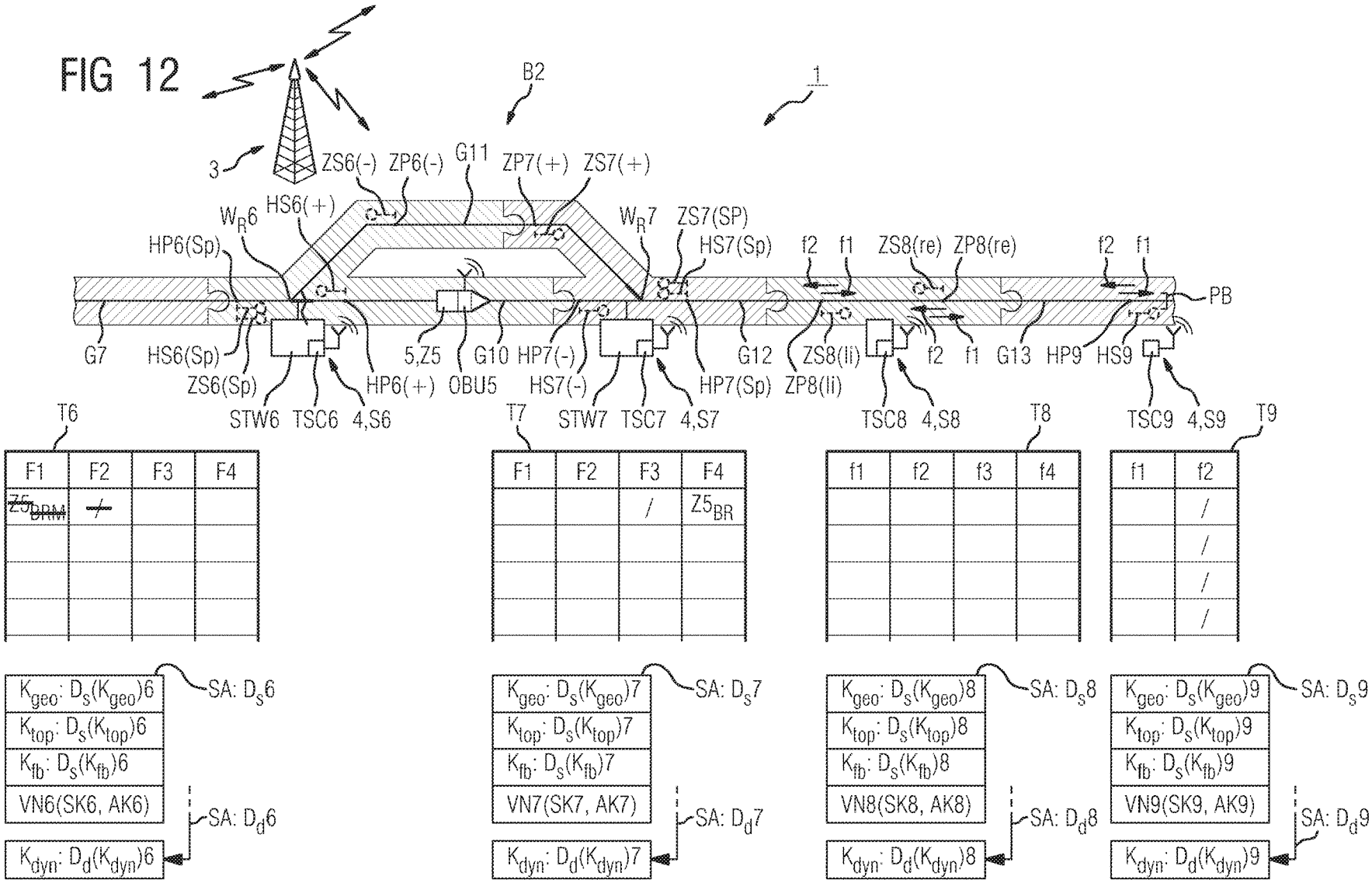
FIG. 12 shows a further section of the rail network, abutting the section shown in FIG. 11 on the right, also with a schematic representation of the track atlas
Figure 13:
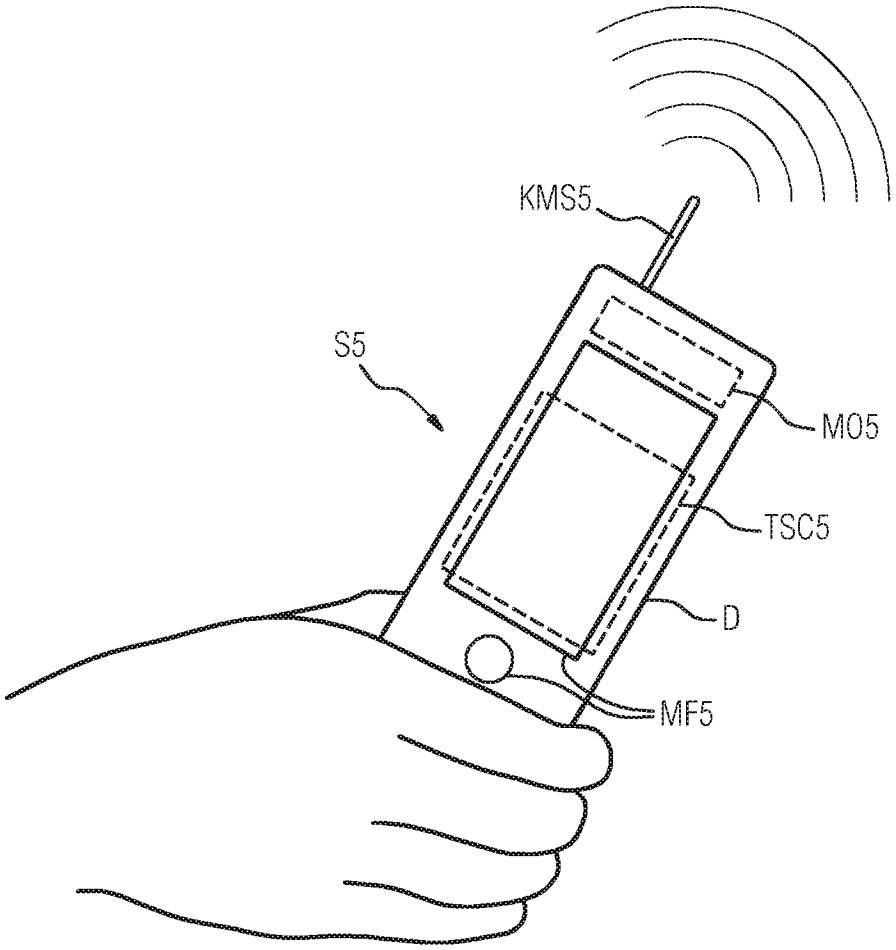
FIG. 13 shows a mobile device of a track element of the protection system according to the invention embodied as a working zone.

A first train Z1 in the direction of travel from left to right, which has entered the rail network 1 via a track element, not shown in the figures, in the form of a entry/exit element FEAFE 1 and which is to leave the rail network 1 via a track element, not shown in the figures, in the form of a entry/exit element FEAFE 2, stands on the track section G1 at a braking target point HP1(−) before the minus side of the switch W1 (see also FIG. 11). A route plan for the train Z1, which is, for example, already in its possession before its entry into the rail network 1 or which it received on entering the rail network 1 from the control room OCC, reads as follows with respect to the track section shown:

Z1|FEAFE1| . . . |W1−|W2−StopB1:20|W3+|W4+| . . . |FEAFE2|

According to this, the train 1 wishes to drive on the switch W1 lying in its minus position and hence in the direction of passage F4 and the switch W2 lying in the minus position from its pointed side and hence in the direction of passage F3. In the rail station B1, the train Z1 wishes to stop for 20 seconds. After stopping, it wishes to drive on the switch W3 lying in the plus position from its plus side and hence in the direction of passage F2 and the switch W4 lying in the plus position from its pointed side and hence in the direction of passage F1. Therefore, the train Z1 wishes to continue its journey on the track sections G3, G5, G6 and G7.

A second train Z2, also in the direction of travel from left to right, which has driven into the rail network 1 via a track element, not shown in the figures, in the form of a entry/exit element FEAFE 3 and which is to leave the rail network 1 via the entry/exit element FEAFE 2, stands on the track section G2 at a braking target point HP1(−) before the plus side of the switch W1.

Its route plan reads with respect to the track section shown:

Z2|FEAFE3| . . . |W1+1W2−|StopB1:25|W3+1W4+| . . . |FEAFE2|

According to this, the train Z2 wishes to drive on the switch W1 lying in the plus position and hence in the direction of passage F2, the switch W2 lying in the minus position from its pointed side and hence in the direction of passage F3, after stopping for 25 seconds in the rail station B1, the switch W3 lying in the plus position from its plus side and hence in the direction of passage F2 and the switch W4 on its pointed side in the plus position and hence in the direction of passage F1 in order to continue its journey on the track sections G3, G5, G6 and G7.

A third train Z3 in the direction of travel from left to right, which has entered the rail network 1 via the entry/exit element FEAFE 1 and which is to leave the rail network 1 via track element, not shown in the figures, in the form of a entry/exit element FEAFE 4, stands on the track section G3 at a braking target point HP2(Sp) before the pointed side of the switch W2.

Its route plan reads with respect to the track section shown:

Z3|FEAFE1| . . . |W2−|StopB1:20|W3+|W4−| . . . |FEAFE4|

According to this, the train Z3 wishes to drive on the switch W2 lying in the minus position from its pointed side and hence in the direction of passage F3, after stopping for 20 seconds in the rail station B1, the switch W3 lying in the plus position from its plus side and hence in the direction of passage F2 and the switch W4 lying in the minus position from its pointed side and hence in the direction of passage F3 in order to continue its journey on the track sections G5, G6 and G7.

A fourth train Z4 in the direction of travel from right to left, which has entered the rail network 1 via the entry/exit element FEAFE 4 and which is to leave the rail network 1 via the entry/exit element FEAFE 1 stands on the track section G6 at a braking target point HP3(Sp) before the pointed side of the switch W3.

Its route plan reads with respect to the track section shown:

Z4|FEAFE4| . . . |W3−|StopB1:25|W2+|W1−| . . . |FEAFE1

According to this, the train Z4 wishes to drive on the switch W3 lying in the minus position from its pointed side and hence in the direction of passage F3, after stopping for 25 seconds in the rail station B1 the switch W2 lying in the plus position from its plus side and hence in the direction of passage F2 and the switch W1 lying in the minus position from its pointed side and hence in the direction of passage F3 in order to continue its journey on the track sections G4, G3 and G1.

The development of the assignment of a track element as a route element for a vehicle and hence the decentralized development of the movement authority for a vehicle takes place via three individual method stages. A first one of these method stages is a route check. A second of these method stages is a route definition. And the third of these method stages is the assignment of the movement authority. These three method stages of the development of the assignment of a track element as a route element for a vehicle are used on the one hand for conflict resolution. On the other hand, they advantageously safeguard loading of the track elements and track sections of the rail network in a manner optimized with respect to demand and usage.

During the route check, the respective vehicle requests a first step for assignment in the form of the entry of an authorization B. To this end, the respective vehicle outputs a request to input the authorization B of the track element as a route element for the vehicle to the respective track element lying in its route. The track element then checks automatically whether it is possible to input this authorization. The track element only prevents the authorization being input if, with respect to the requested input, there is already an entry of an authorization for another vehicle in directly the opposite direction. Otherwise, the respective track element can continue to be used for other vehicles (trains). Therefore, it can output assignments as a route element to other vehicles so that they can use the track element in their own route. If it is possible to input an authorization, the track element makes this entry and then issues confirmation that the authorization has been input to the respective vehicle.

During the route definition, the respective vehicle requests a second step for assignment in the form of the input of a registration R. To this end, the respective vehicle outputs a request to the respective track element lying in its route for the input of the registration R of the track element as a route element for the vehicle. The track element then automatically checks whether it is possible to input this registration. Under predefined circumstances, the track element stops the registration being input. Otherwise, the respective track element can still be used for other vehicles (trains). Therefore, it can output assignments as a route element to other vehicles so that these can use the track element in their own route. If it is possible to input a registration, the track element makes this input and then outputs a confirmation that the registration has been input to the respective vehicle.

On granting of the movement authority, the respective vehicle requests a third step for assignment in the form of the entry of a marking M. To this end, the respective vehicle outputs to the respective track element in its route a request for the marking of the track element to be input as a route element for the vehicle. The track element automatically checks again whether this marking of the registration is possible. Under predefined circumstances, the track element stops the marking being input. If the input of the marking is possible, the track element inputs the marking, initiates, if necessary, the changeover of the track element and then outputs confirmation of the entry of the marking to the respective vehicle. All other vehicles that request the input of a marking have to wait until the marking that has been input is deleted again.

Reception of confirmation of the input of the marking now authorizes the respective vehicle to use the track element as a route element and to advance over the track element into the following track section as far as a predefined point before the next track element, wherein it knows the predefined point from the track topology—i.e. from a topological component of a track atlas. The vehicle also comprises a position-finding system so that it always knows which point in the rail network is its present location.

On passing the track element, the respective vehicle outputs confirmation of passage to the respective track element. On reception of this confirmation of passage, the respective track element deletes the authorization that has been input, the registration that has been input and the marking that has been input.

To carry out the three steps for assignment, each track element control TSCi of the track elements manages memory locations.

In the first embodiment of the protection system according to the invention, the memory locations of the individual track elements in each case form cells of a table Ti, where i=1 to p. The columns in these tables correspond to the different types of loading of the respective track element. For example, the switches shown in each case comprise four types of loading identified in the figures by arrows F1, F2, F3 and F4. Other track elements, such as, for example, entry/exit elements, derailment detectors or working zones established to be mobile comprise two types of loading identified in the figures by arrows f1 and f2. The track element control of a track element embodied as a bumper manages memory locations of two types of loading, wherein, however, the memory locations of the one type of loading are permanently assigned a blocking entry identified with "/".

In the protection method according to the invention for the rail network, which is divided by the track elements S1, S2, . . . , Sp into the track sections G1, G2, . . . , Gq and on which the vehicles Z1, Z2, . . . , Zr can travel in dependence on data from components of a track atlas, therefore, the vehicles Z1, Z2, . . . , Zr request, from selected track elements, the steps B, R, M for assignment as a route element.

In the protection system according to the invention for a rail network, which is divided by track elements S1, S2, . . . , Sp into a plurality of track sections G1, G2, . . . , Gq and on which vehicles Z1, Z2, . . . , Zr can travel in dependence on data from components of a track atlas, therefore, the vehicles Z1, Z2, . . . , Zr are suitably embodied to request, from selected track elements, steps B, R, M for assignment as a route element. Moreover, each Si, where i=1 to p, of the selected track elements is suitably embodied automatically to assign itself as a route element, under predefined conditions, in each case for each vehicle Zm where, m=1 to r, which requests the steps for assignment as a route element from it and to output an assignment confirmation $Q_M$m,I, where m=1 to r and i=1 to p, to the respective vehicle.

Herein, each Si, where i=1 to p, of the selected track elements in each case automatically assigns itself as a route element, under predefined conditions, for each vehicle Zm, where m=1 to r, which requests the steps for assignment as a route element from it in that, in response to a first request $A_B$ZmSi, where m=1 to r and i=1 to p, of the respective vehicle Zm, where m=1 to r, in a type of loading F1; F2; F3; F4; f1; f2 requested by the respective vehicle, it makes its authorization B as a route element for the respective vehicle Zm, where m=1 to r, in response to a second request $A_R$ZmSi, where m=1 to r and i=1 to p, of the respective vehicle Zm, where m=1 to r, makes its registration R as a route element for the respective vehicle, and in response to a third request $A_M$ZmSi, where m=1 to r and i=1 to p, of the respective vehicle Zm, where m=1 to r, makes its marking M as a route element for the respective vehicle.

Therefore, the vehicle control OBUm of the respective vehicle Zm, where m=1 to r, determines, to request the steps for assignment from the respective track element Si, where i=1 to p, the requirements $A_B$m,i, $A_R$m,i, $A_M$m,i, where m=1 to r and i=1 to p, and outputs the requirements to the respective track element Si, where i=1 to p, by means of communication means KMZm assigned to the vehicle control OBUm.

Therefore, a vehicle control OBUm of the respective vehicle Zm, where m=1 to r, is suitably embodied, to request the steps for assignment from the respective track element Si, where i=1 to p, to determine requirements $A_B$m, $A_R$m,i, $A_M$m,i, where m=1 to r and i=1 to p, and to output the requirements to the respective track element Si, where i=1 to p, by means of communication means KMZm assigned to the vehicle control OBUm.

The track element control TSCi of the respective track element Si, where i=1 to p, receives the requirements $A_B$m,i, $A_R$m,i, $A_M$m,i, where m=1 to r and i=1 to p, of the respective vehicle Zm, where m=1 to p, relating to the respective track element by means of communication means KMSi assigned to the track element control TSCi.

Therefore, the track element control TSCi of the respective track element Si, where i=1 to p, is suitably embodied to receive the requirements $A_B$m,i, $A_R$m,i, $A_M$m,i, where m=1 to r and i=1 to p, of the respective vehicle Zm, where m=1 to r, relating to the respective track element by means of communication means KMSi assigned to the track element control TSCi.

The track element control TSCi of the respective track element Si, where i=1 to p, uses the received requirements to determine the assignment of the respective track element Si, where i=1 to p, as a route element for the respective vehicle Zm, where m=1 to r, and outputs the respective assignment confirmation $Q_M$m,i, where m=1 to r and i=1 to p, to the respective vehicle Zm, where m=1 to p, by means of the communication means KMSi assigned to the track element control TSCi.

Therefore, the track element control TSCi of the respective track element Si, where i=1 to p, is suitably embodied to use the received requirements to determine the assignment of the respective track element Si, where i=1 to p, as a route element for the respective vehicle Zm, where m=1 to r, and to output the respective assignment confirmation $Q_M$m,i, where m=1 to r and i=1 to p, to the respective vehicle (Zm, where m=1 to r) by means of the communication means KMSi assigned to the track element control TSCi.

Herein, the predefined conditions (rules) are worded as follows:

I: The respective track element Si, where i=1 to p, only makes the authorization B requested from it in the one type of loading F1; F2; F3; F4; f1; f2 as a route element for the respective vehicle Zm, where m=1 to r, if it has not already made its authorization B for another vehicle Zn, where n=1 to r and n≠m, in a type of loading F2; F1; F4; F3; f2; f1 opposite to the one type of loading F1; F2; F3; F4; f1; f2 and has not yet cancelled this authorization.

II: The respective track element Si, where i=1 to p, only makes its registration R as a route element for the respective vehicle Zm, where m=1 to r, if it has previously made its authorization B as a route element for the respective vehicle Zm, where m=1 to r, in the one type of loading F1; F2; F3; F4; f1; f2 and has not yet cancelled this authorization B.

III: The respective vehicle Zm, where m=1 to r, only outputs the second request $A_R$ZmSi, where m=1 to r and i=1 to p, for registration of the respective track element Si, where i=1 to p, as a route element to this track element Si, where i=1 to p, if the track element Sk with k=1 to p, and k≠i adjacent upstream to this track element in the direction of travel of this vehicle Zm, where m=1 to r, has made its marking M as a route element for this vehicle Zm, where m=1 to r, and has not yet cancelled this marking M.

IV: The respective track element Si, where i=1 to p, only makes its marking M as a route element for the respective vehicle Zm, where m=1 to r, if it has previously made its registration R as a route element for this vehicle Zm, where m=1 to r, and has not yet cancelled this registration R.

V: The respective track element Si, where i=1 to p, only makes its marking M as a route element for the respective vehicle if it has not already made its marking M as a route element for another vehicle Zn, where n=1 to r and n≠m, and has not yet cancelled this marking.

VI: The respective track element Si, where i=1 to p, only makes its marking M as a route element for the respective vehicle Zm, where m=1 to r, if, before its registration R as a route element for this vehicle Zm, where m=1 to r, it has not already made its authorization B for another vehicle Zn, where n=1 to r and n≠m, for which it has also made its registration R as a route element in the respective a type of loading and has not yet cancelled this registration R.

VII: If it is embodied as a switching device and if the one type of loading for which it has made its authorization B for the respective vehicle Zm, where m=1 to r, proceeds from the blunt side of the switch W in the switching device, the respective track element Si, where i=1 to p, only makes its marking M as a route element for this vehicle Zm, where m=1 to r, if it has not already made its authorization B for another vehicle Zn, where n=1 to r and n≠m, for which it has made its registration R as a route element in a type of loading proceeding from the pointed side of the switch W and has not yet cancelled this registration R.

VIII: If it is embodied as a switching device and if the one type of loading for which it has made its authorization B for the respective vehicle Zm, where m=1 to r, proceeds from the pointed side of the switch W of the switching device, the respective track element Si, where i=1 to p, only makes its registration R as a route element for this vehicle Zm, where m=1 to r, if it has not already previously made its authorization B for another vehicle for which it has made its registration R and its marking M as a route element in a type of loading proceeding from the blunt side of the switch W and has not yet cancelled this marking M.

IX: And the respective vehicle Zm, where m=1 to r, only enters a track section Gx, where x=1 to q, between adjacent track elements Si, Sj where i=1 to p and j=1 to p and i≠j, or uses a track section Gx, where x=1 to q, between adjacent track elements Si, Sj where i=1 to p and j=1 to p and i≠j, if these two adjacent track elements in each case have made, and not cancelled, both their authorization B and their registration R as a route element for this vehicle Zm, where m=1 to r.

Figure 1B:
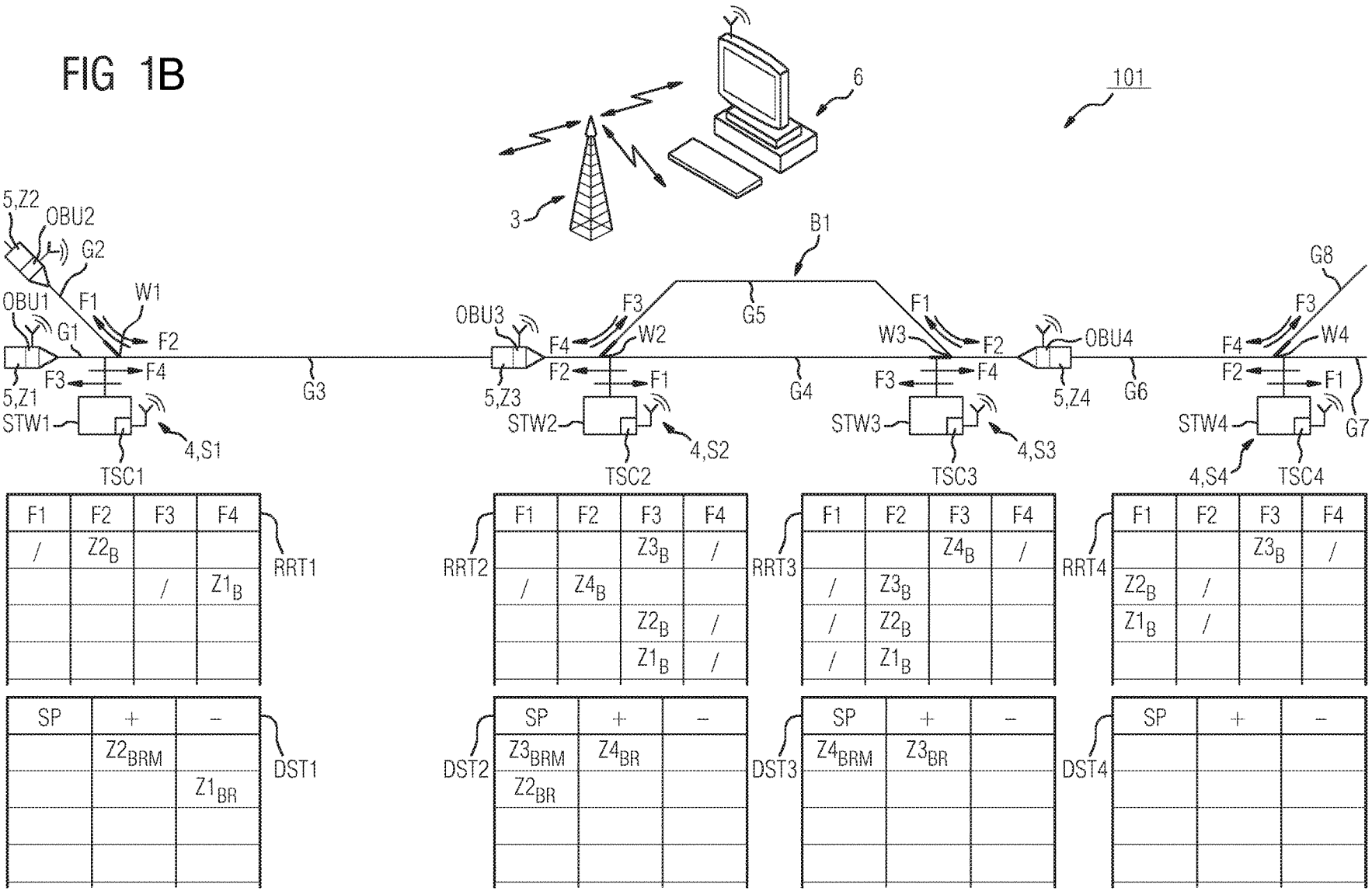
FIG. 1*b* shows the section of the rail network in FIG. 1*a* at the time point in FIG. 1*a*, which is equipped with a second embodiment of the protection system according to the invention.

In the second embodiment of the protection system according to the invention in FIG. 1*b*, the memory locations of the individual track elements Si in each case form cells of two separate tables. On the one hand, cells of a route request table designated RRTi, where i=1 to p, and, on the other, cells in a drive sequence table designated DSTi, where i=1 to p.

The predefined conditions (rules) are then worded as follows:

i: A vehicle can only be entered in the route request table RRTi as long as no other vehicle has been entered for the opposite direction of travel.

ii: It is always the case that only one vehicle can be marked in the drive sequence table DSTi. Any further request for a marking to be input in the drive sequence table DSTi will be rejected if a marking has already been assigned or the vehicle is not the first vehicle in the columns of the drive sequence table DSTi.

iii: A vehicle can only be registered in the column "SP" as long as there is still no marking in the columns "plus" or "minus".

iv: A marking for a vehicle in one of the columns "plus" or "minus" can only be assigned as long as no vehicle is registered in the column "Sp".

v: To use a section between two track elements, a vehicle requires a confirmed registration in both tables, both for of the track element via which the vehicle enters the respective track section (i.e. which forms an entry point) and for the track element via which the vehicle exits the respective track section (i.e. which forms an exit point).

vi: A vehicle can request a registration in the table DSTi of the exit point if there is a marking for it for the entry point. Therefore, a vehicle can advance as far as a track element if it is registered with this track element and all track elements on the way thereto are marked for it.

As already mentioned in the introduction, a track element S5 is provided, which, after its integration into the rail network, forms a working zone AZ.

The track element S5 embodied as a working zone is in particular characterized in that it only outputs the assignment confirmation $Q_M$m,5, where m=1 to r, for the respective vehicle Zm, where m=1 to r, after the inputting of an assignment release Fm,5, where m=1 to r, wherein the at least one track element S5 is provided with means MF5 for release, by means of which the assignment release Fm,5, where m=1 to r, is input manually.

The track element S5 is therefore suitably embodied, after its integration into the rail network, to form a working zone AZ and only to output the assignment confirmation $Q_M$m,5, where m=1 to r, for the respective vehicle Zm, where m=1 to r, after the inputting of an assignment release Fm,5, where m=1 to r, wherein the at least one track element S5 comprises means MF5 for release, by means of which the assignment release Fm,5, where m=1 to r, is to be input manually.

The track element S5, which forms the working zone AZ is temporarily integrated into the rail network between two initially adjacent track elements (S1, S2) and removed again therefrom.

The at least one track element S5 which forms the working zone AZ is therefore suitably embodied to be integrated temporarily into the rail network between two initially adjacent track elements (S1, S2) and removed again therefrom.

The at least one track element S5, which forms the working zone AZ is provided with means MO5 for the determination of its present position and outputs the present location of the working zone AZ between the two track elements (S1, S2) in dependence on its present position.

Therefore, the at least one track element S5, which forms the working zone AZ comprises means MO5 for the determination of its present position and is suitably embodied to specify the present location of the working zone AZ between the two track elements (S1, S2) in dependence on its present position.

In the at least one track element which forms the working zone AZ, the track element control TSC5, the means MF5 for release and the means MO5 for the determination of the present position are provided as components of a mobile device D, which is in particular portable by a person.

Therefore, in the at least one track element S5 which forms the working zone AZ, the track element control TSC5, the means MF5 for release and the means MO5 for the determination of the present position are embodied as components of a mobile device D, which is in particular portable by a person.

Figure 10:
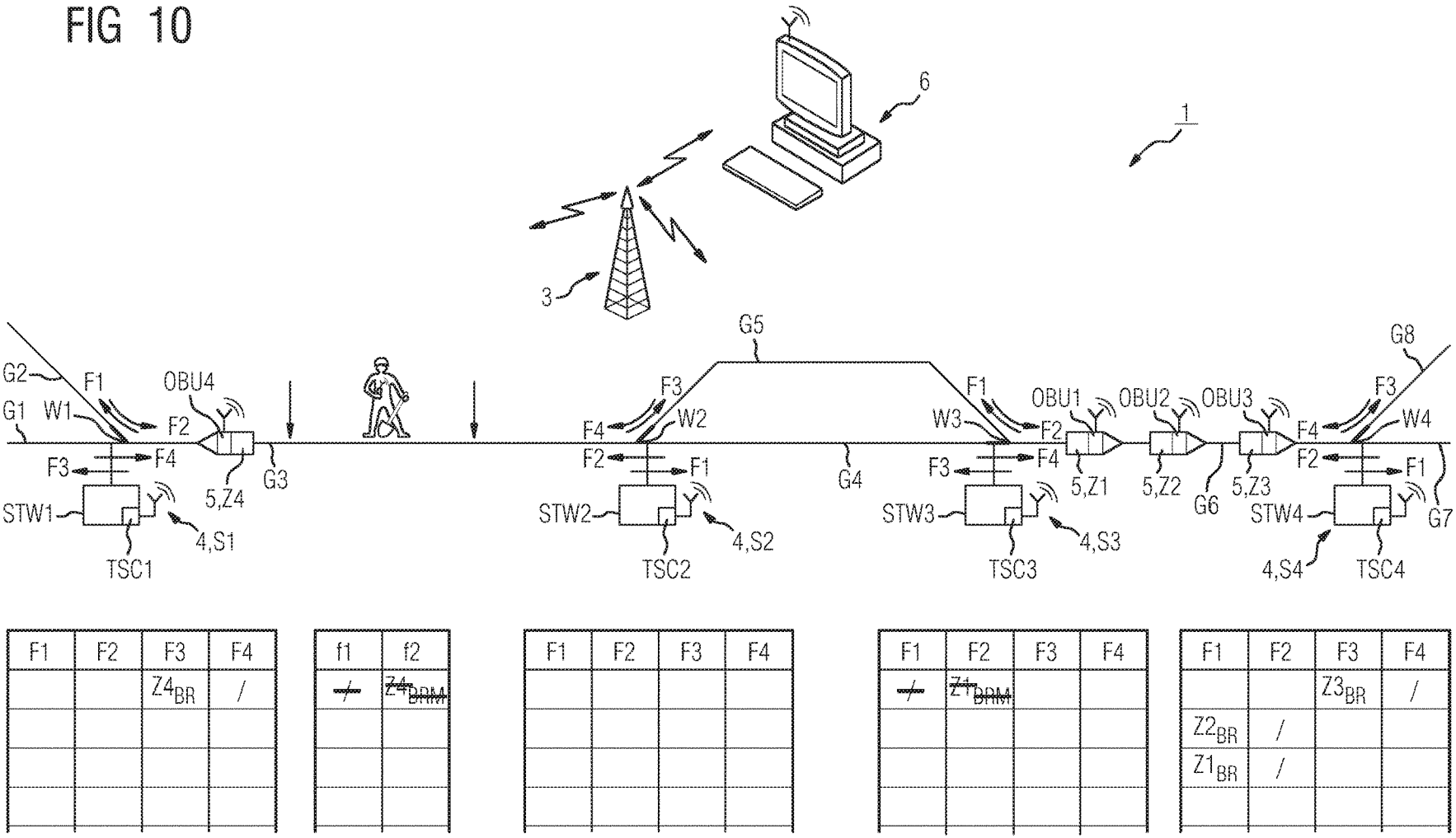

According to FIGS. 10 and 11, in the protection method according to the invention for a rail network, the data for at least one of the components $K_{geo}$, $K_{top}$, $K_{fb}$ of the track atlas SA is deposited locally in the form of data records $D_s$1, $D_s$2, . . . , $D_s$p in the track elements S1, S2, . . . , Sp in parts related to the track elements $D_s(K_{geo})$1, $D_s(K_{top})$1, $D_s(K_{fb})$1, $D_s(K_{geo})$2, $D_s(K_{top})$2, $D_s(K_{fb})$2, . . . , $D_s(K_{geo})$p, $D_s(K_{top})$p, $D_s(K_{fb})$p.

Therefore, in the protection system according to the invention, the data for at least one of the components $K_{geo}$, $K_{top}$, $K_{fb}$ of the track atlas SA is deposited locally in the form of data records $D_s$1, $D_s$2, . . . , $D_s$p in parts related to the track elements $D_s(K_{geo})$1, $D_s(K_{top})$1, $D_s(K_{fb})$1, $D_s(K_{geo})$2, $D_s(K_{top})$2, $D_s(K_{fb})$2, . . . , $D_s(K_{geo})$p, $D_s(K_{top})$p, $D_s(K_{fb})$p.

A first component of the track atlas (SA), the data of which is to be or is deposited in parts $D_s(K_{geo})$1, $D_s(K_{geo})$2, . . . , $D_s(K_{geo})$p in the track elements, is provided as a geometric component $K_{geo}$ with geometric and position-finding data for determining the position of the vehicles in the rail network.

Herein, the following are to be or are provided as geometric and position-finding data:

- position data for the track elements in the rail network and/or
- position data for ends of track sections of the track sections linked by the track elements in the rail network and/or
- position data for adjusting elements in the track sections linked by the track elements and/or
- length data for the track sections linked by the track elements and/or
- course data for track sections linked by the track elements.

A second component of the track atlas SA, the data of which is to be or is deposited in parts $D_s(K_{fb})$1, $D_s(K_{fb})$2, . . . , $D_s(K_{fb})$p in the track elements, is provided as a driving-operation component $K_{fb}$ with location-related driving-operation data for controlling and monitoring the driving performance of the vehicles and/or for controlling the track elements.

Herein, the following are provided as driving-operation data:

- gradient-profile data for the track sections linked by the track elements and/or
- train-class-dependent speed-limiting data relating to the track sections linked by the track elements and/or
- braking target point data for braking target points on the track sections linked by the track elements and/or
- release-point data for release points on the track sections linked by the track elements and/or
- supporting-point data for supporting points on the track sections linked by the track elements A third component of the track atlas SA, the data of which is to be or is deposited in parts $D_s(K_{top})$1, $D_s(K_{top})$2, . . . , $D_s(K_{top})$p in the track elements, is provided as a topographic component $K_{top}$ with topological data that reflects the topological structure of the rail network.

Herein, the following are to be or are provided as topological data:

- linking data for ends of track sections of the track sections linked by the track elements in the rail network and/or
- orientation data for the track sections linked by the track elements in the rail network.

A track-element identification SKi, where i=1 to p, is to be or is provided as part of each of the data records and uniquely identifies the track element to which the data record $D_s$i, where i=1 to p, relates.

Moreover, an up-to-dateness identification AKi, where i=1 to p, is to be or is provided as part of each of the data records and identifies a degree of up-to-dateness of the data record $D_s$i, where i=1 to p.

The track-element identification SKi, where i=1 to p, and/or the up-to-dateness identification AKi, where i=1 to p, are to be or are provided by a version number VNi, where i=1 to p.

On a modification of the rail network 1, the data records for the track elements affected by the modification are modified locally in the track elements. Therefore, the track elements are embodied such that, on a modification of the rail network, the data records for the track elements affected by the modification can be modified locally in the track elements.

In the case of a first-time authorization B or in the case of a first-time registration R of a respective track element for a respective vehicle, the entire data record of the track element is transmitted to the vehicle and deposited there. Therefore, the track elements and the vehicles are embodied such that, in the case of a first-time authorization B or in the case of a first-time registration R of a respective track element for a respective vehicle, the entire data record of the track element is transmitted to the vehicle and deposited there.

In the case of a repeat authorization B or in the case of a repeat registration R of a respective track element for a respective vehicle, at least some items of the data from the data record, which was deposited in the track element, are transmitted to the vehicle if the degree of up-to-dateness of a data record deposited in the vehicle and assigned to the track element deviates from the degree of up-to-dateness of the data record deposited in the track element. Therefore, the track elements and the vehicles are embodied such that, in the case of a repeat authorization B or in the case of a repeat registration R of a respective track element for a respective vehicle from the data record, which was deposited in the track element, at least some items of the data are transmitted to the vehicle and deposited there if the degree of up-to-dateness of a data record deposited in the vehicle and assigned to the track element deviates from the degree of up-to-dateness of the data record deposited in the track element.

In the protection system according to the invention, the vehicles Z1, Z2, . . . , Zr deposit in the track elements manually input and/or manually released dynamic driving-operation data $D_d$1, $D_d$2, . . . , $D_d$p as a dynamic component $K_{dyn}$ of the track atlas SA in parts $D_d(K_{dyn})$1, $D_d(K_{dyn})$2, . . . , $D_d(K_{dyn})$p related to the track elements.

Therefore, in the protection system according to the invention, the vehicles Z1, Z2, . . . , Zr are suitably embodied to deposit in the track elements manually input and/or manually released dynamic driving-operation data $D_d$1, $D_d$2, . . . , $D_d$p as a dynamic component $K_{dyn}$ of the track atlas in parts $D_d(K_{dyn})$1, $D_d(K_{dyn})$2, . . . , $D_d(K_{dyn})$p related to the track elements.

Herein, the following are to be or are provided as dynamic driving-operation data:

- characteristic data for slippery sections on the track sections linked by the track elements and/or
- characteristic data for speed restrictions on the track sections linked by the track elements and/or
- characteristic data for track blocks on the track sections linked by the track elements.

In the protection system according to the invention, each Si, where i=1 to p, of the selected track elements in each case specifies for each vehicle Zm, where m=1 to r, which requests at least one of the steps B, R, M for assignment as a route element from it, at least one signal HS; ZS.

Therefore, in the protection system according to the invention, each Si, where i=1 to p, of the selected track elements is suitably embodied in each case to specify for each vehicle Zm, where m=1 to r, which requests at least one of the steps B, R, M for assignment as a route element from it, at least one signal HS; ZS.

Herein, the respective track element Si, where i=1 to p, specifies for the respective vehicle Zm, where m=1 to r, the type, the position and the status of the at least one signal HS; ZS.

Therefore, the respective track element Si, where i=1 to p, is suitably embodied to specify for the respective vehicle Zm, where m=1 to r, the type, the position and the status of the at least one signal HS; ZS.

At least one of the signals is to be or is specified as a virtual main signal HS at a braking target point HP, which is a danger point.

At least one of the signals is to be or is specified as a virtual target signal ZS at a braking target point ZP, which is not a danger point.

In the method according to the invention, different types of train headway points ZFT.I, ZFT.II are specified. In addition, the vehicles provide different braking curves $BKm_A$.I, $BKm_A$.II of the same type of braking curve A. Herein, each of the different braking curves of the same type of braking curve A of the respective vehicle Zm, where m=1 to r, is in each case assigned to one of the different types of train headway points.

At least one braking target point HP, which is a danger point, forms a train headway point of a first type of train headway point ZFT.I, which is assigned to first braking curve $BKm_A$.I of the respective vehicle. In the figures, such braking target points HP are, for example, the braking target points: HP1(−), HP1(+), HP1(Sp), HP2(Sp), HP2(+), HP3(−), HP3(Sp), HP4(Sp), HP4(+), HP4(−), HS6(Sp), HP6(+), HP7(−), HP7(Sp) and HP9, wherein this list is not complete.

A track element embodied as a switching device specifies at least one braking target point HP, which is a danger point.

A track element embodied as a bumper PB also specifies at least one braking target point HP, which is a danger point.

In addition, in a track section Gx with x=1 to q, a vehicle end ZE of a stationary vehicle Zm, where m=1 r, specifies for a following vehicle Zn, where n=1 to r and n≠m, at least one braking target point HP, which is a danger point.

At least one braking target point ZP, which is not a danger point, forms a train headway point of a second type of train headway point ZFT.II, to which a second braking curve $BKm_A$.II of the respective vehicle Zm, where m=1 to r, is assigned. In the figures, such braking target points ZP are, for example, the braking target points: ZP2(−), ZP3(+), ZP6(−), ZP6(SP), ZP7(+), ZP7(Sp), ZS8(*li*) and ZS8(*re*), wherein this list is not complete.

A track element embodied as a spring-loaded switch $W_R$ specifies at least one further braking target point ZP, which is not a danger point.

In addition, in a track section Gx with x=1 to q, a vehicle end ZE of a moving vehicle Zm, where m=1 r, specifies for a following vehicle Zn, where n=1 to r and n≠m, at least one further braking target point ZP, which is not a danger point.

Furthermore, a track element embodied as a fictitious double entry/exit element FDME specifies at least one braking target point ZP, which is not a danger point.

According to the above-listed conditions (rules) I. to X. or i. to vi., the track elements Si shown in FIGS. 1*a* or 1*b* and 2 to 10 have made the following entries in the tables Ti or RRi and DSTi with respect to the vehicles (trains) Zm:

In FIG. 1*a*, the track element S1 has made its authorization B in response to the first request . . . of the vehicle Z2 in the type of loading F2 requested by the vehicle Z2. This is indicated in the table T1 by the subscript "B" to the reference sign "Z1". In addition, in response to the second request . . . of the vehicle Z2, the track element S1 has made its registration R as a route element for the vehicle Z2. This is indicated in the table T1 by the subscript "R" to the reference sign "Z1". Furthermore, in response to the third request . . . of the vehicle Z2, the track element S1 has made its marking M as a route element for the vehicle Z2. This is indicated in the table T1 by the subscript "M" to the reference sign "Z1". Therefore, the storage entry made by the track element S1 for the vehicle Z2 is designated $Z2_{BRM}$ as a whole in the table T1. The adjacent cell on the left is—in accordance with the rules—provided with a blocking entry indicated by "/".

For the vehicle Z1, in addition to its authorization B in the type of loading F4, the track element S1 has also made its registration R. Therefore the storage entry, which the track element S1 has made for the vehicle Z1, is designated $Z1_{BR}$ in the table T1. The adjacent cell on the left is—in accordance with the rules—again provided with a blocking entry indicated by "/".

Therefore, the vehicle Z2 is allowed to pass the track element S1 before the vehicle Z1. To this end, together with the definition of the marking, the track element S1 has initiated the changeover of the switch W1 by the operating element STW1 into its plus position as long as this was not already in the plus position. As soon as the vehicle, after crossing the switch W1, has passed a release point, not shown here for reasons of clarity, relating to the track element 1, the vehicle outputs a corresponding confirmation of passage to the track element S1, which then deletes the storage entry $Z2_{BRM}$ and the blocking entry "/" shown adjacent on the left—i.e. withdraws or cancels its authorization, registration and marking for the vehicle Z2 (see FIG. 2). The vehicle Z1 was only permitted to travel to the switch W1 as far as the braking target point HP1(−).

Correspondingly, the track element S2 has made entries $Z3_{BRM}$ in column "F3" for the vehicle Z3, $Z4_{BR}$ in column "F2" for the vehicle Z4, $Z2_{BR}$ in column "F3" for the vehicle Z2 and $Z1_B$ in column "F3" for the vehicle Z1 in the memory locations of the track element control TSC2 (in the cells in Table T2) and also the blocking entries "/" resulting therefrom. Therefore, at the time point shown in FIG. 1*a*, the track element S2 has only automatically assigned itself to the vehicle Z3 as a route element. However, the vehicle Z2 is only permitted to travel to the switch W2 as far as the braking target point HP2(Sp). In addition, the vehicle Z4 is permitted to travel to the switch W2 as far as the braking target point HP2(+).

At the time point shown in FIG. 1*a*, the track element S3 has made its entries $Z4_{BRM}$ in column "F3" for the vehicle Z4, $Z3_{BR}$ in column "F2" for the vehicle Z3, $Z2_B$ in column "F2" for the vehicle Z2 and $Z1_B$ in column "F2" for the vehicle Z1 in the memory locations of the track element control TSC3 (in the cells in Table T3) and also the blocking entries "/" resulting therefrom. Therefore, at the time point shown in FIG. 1, the track element S3 has only automatically assigned itself to the vehicle Z4 as a route element. However, the vehicle Z3 is permitted to travel to the switch W3 as far as the braking target point ZP3(+).

At the time point shown in FIG. 1*a*, the track element S4 has made its entries $Z3_B$ in column "F3" for the vehicle Z3, $Z2_B$ in column "F1" for the vehicle Z2 and $Z1_B$ in column "F1" for the vehicle Z1 in the memory locations of the track element control TSC4 (in the cells in Table T4) and also the blocking entries "/" resulting therefrom. Therefore, at the time point shown in FIG. 1, the track element S4 has not assigned itself to any of the vehicles as a route element and therefore cannot be crossed by any of the vehicles. Since it has also not made any authorization as a route element, it is also not permitted for any of the vehicles to enter the track sections linking the switch W4. The vehicle Z4 has already passed a release point, not shown here for reasons of clarity, related to the track element S4, and output a corresponding confirmation of passage to the track element S4 so that the track element S4 has already withdrawn—i.e. deleted—its entries for the vehicle Z4.

Figure 2:
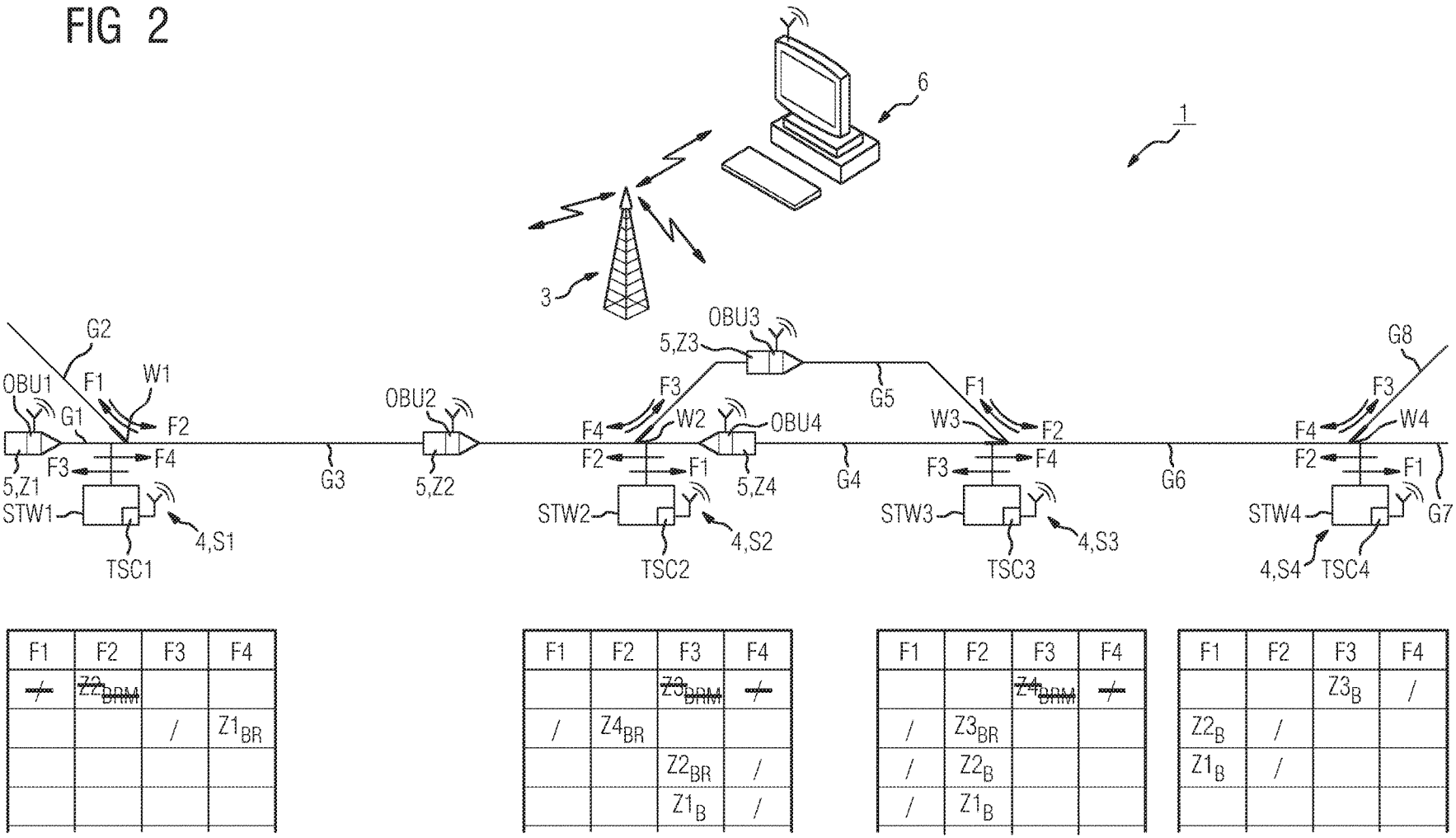
FIGS. 2 to 10 show the section of the rail network in FIG. 1*a*, which is equipped with the first embodiment of the protection system according to the invention, at other time points.

At the time point shown in FIG. 2, the track element S1 has deleted its entry $Z2_{BRM}$ for the vehicle Z2 and the blocking entry "/" resulting therefrom. Furthermore, the track element S2 has deleted its entry $Z3_{BRM}$ and the blocking entry "/" resulting therefrom. In addition, the track element S3 has deleted its entry $Z4_{BRM}$ and the blocking entry "/" resulting therefrom.

Figure 3:
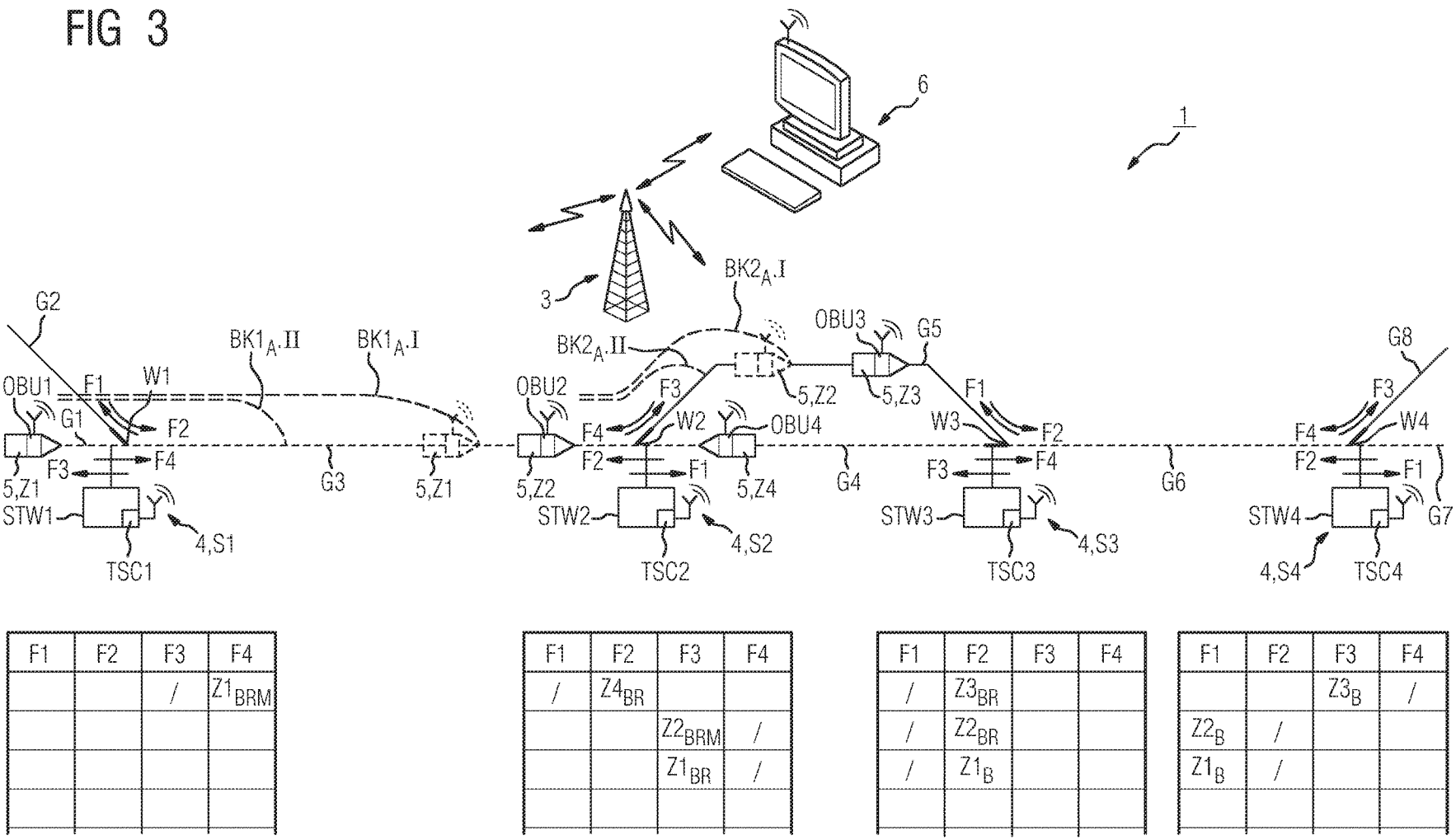

Compared to the time point shown in FIG. 1*a*, at the time point shown in FIG. 3, the track element S1 has now made its marking M for the vehicle Z1 and hence completed its automatic assignment for the vehicle Z1. The track element control TSC1 initiates the changeover of the switch W1 into its minus position by the operating element STW1.

At the time point shown in FIG. 3, the track element S2 has made its marking M for the vehicle Z2 and hence completed its automatic assignment for the vehicle Z2. The track element control TSC2 initiates the changeover of the switch W2 into its minus position by the operating element STW2.

However, initially, the vehicle Z2 is not permitted to enter the rail track section G5 as long as the track element S3 has still not made a registration R for the vehicle Z2. Accordingly, the vehicle Z1 is also not initially permitted to enter the rail track section G3. The vehicle Z2 outputs its second request for registration of the track element S3 as a route element to the track element S3. In response to this second request, the track element S3 informs the vehicle Z2 that it has already made its registration for the vehicle Z3, notifies it of the communication address of the vehicle Z3 and makes its registration for the vehicle Z2. The vehicle Z2 then makes contact with the vehicle Z3. On the basis of the present position in each case of the vehicle end of the vehicle Z3, the vehicle Z2 is in each case specified a present braking target point ZP(Z3) or HP(Z3) at which the vehicle Z2 then moves behind the vehicle Z3. The present braking target point ZP(Z3) is not a danger point and hence therefore a train headway point of the second type of train headway point ZFT.II as long as the vehicle Z3 is travelling in the direction of the track element S3—i.e. continues to move forward. As a result, the vehicle Z2 then switches on its steep braking curve $BK2_A$.II in order to follow the vehicle Z3 quickly even if herein it would slip slightly over the braking target point ZP(Z3). However, as soon as the vehicle Z3 has come to a halt at the braking target point ZP3(+), the present braking target point is a danger point and hence also a train headway point of the second type of train headway point ZFT.II. As a result, the vehicle Z2 then switches from its steep braking curve $BK1_A$.II to its flat braking curve $BK2_A$.I since it is not permitted to slip beyond the braking target point HP(Z3).

In the same way, the vehicle outputs Z1 its second request for registration of the track element S2 as a route element to the track element S2. In response to this second request, the track element S2 informs the vehicle Z1 that it has already made its registration for the vehicle Z2, notifies it of the communication address of the vehicle Z2 and makes its registration for the vehicle Z1. The vehicle Z1 then makes contact with the vehicle Z2. On the basis of the present position in each case of the vehicle end of the vehicle Z2, the vehicle Z1 is in each case specified a present braking target point at which the vehicle Z1 then presently moves behind the vehicle Z2. Here, once again, the present braking target point ZP(Z2) is not a danger point and hence therefore a train headway point of the second type of train headway point ZFT.II as long as the vehicle Z2 is travelling in the direction of the track element S2—i.e. continues to move forward. As a result, the vehicle Z1 then switches on its steep braking curve $BK1_A$.II in order to follow the vehicle Z2 quickly even if herein it would slip slightly over the braking target point ZP(Z2). However, if the vehicle Z2 were, for example, to have come to a halt before the switch W2 at the braking target point HP2(Sp), the present braking target point for the vehicle Z1 would be a danger point and hence also a train headway point of the second type of train headway point ZFT.II. As a result, the vehicle Z1 would then switch from its steep braking curve $BK1_A$.II to its flat braking curve $BK1_A$.I since it is not permitted to slip beyond the braking target point HP2(SP).

Figure 4:
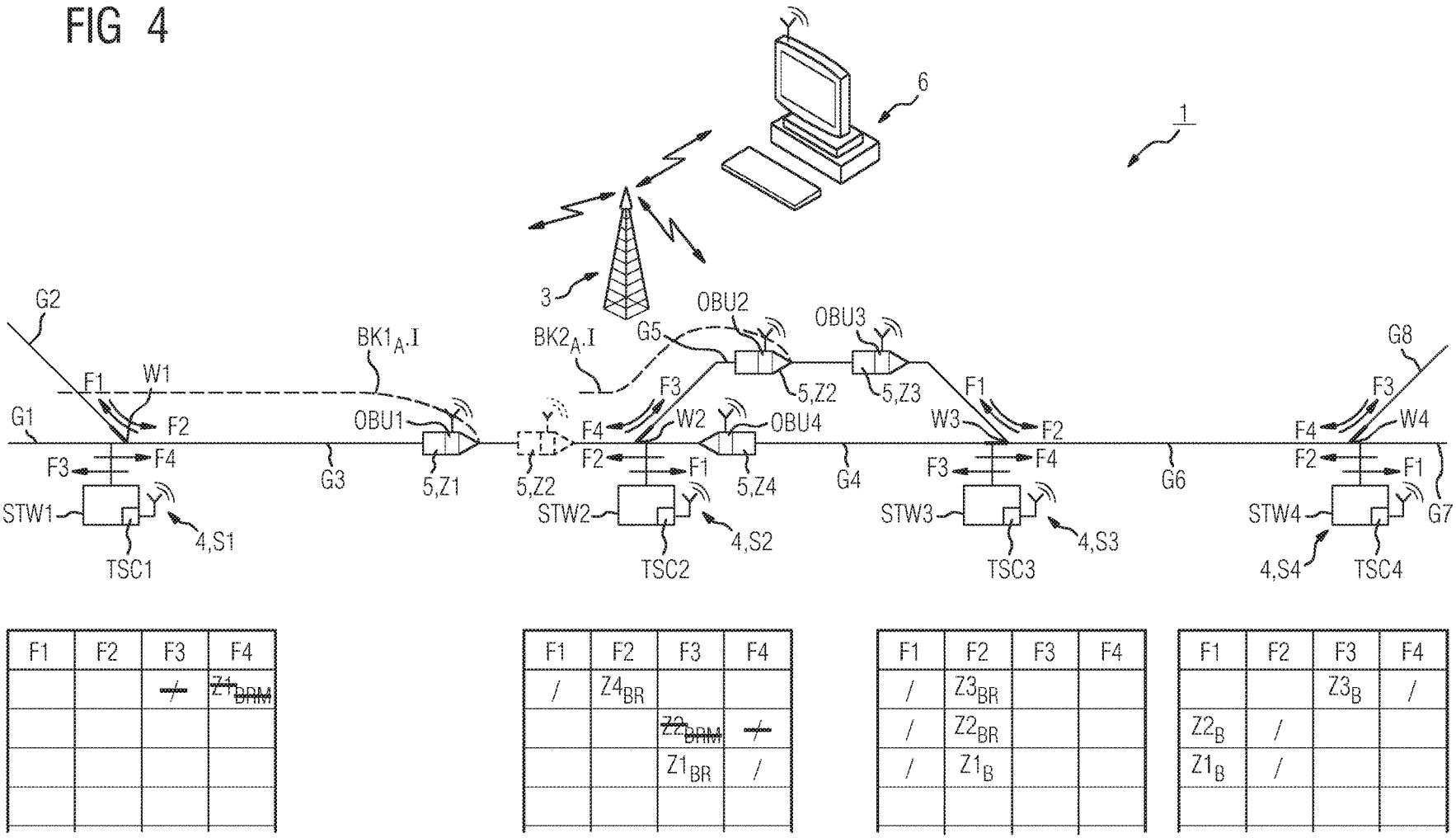

At the time point shown in FIG. 4, the vehicle Z1 is initially not permitted to enter the rail track section G5 since the track element S3 has not yet made a registration R for the vehicle Z1.

The vehicle Z1 outputs its second request for registration of the track element S3 as a route element to the track element S3. In response to this second request, the track element S3 informs the vehicle Z1 that it has already made its registration for the vehicle Z2, notifies it of the communication address of the vehicle Z2 and makes its registration for the vehicle Z1. The vehicle Z1 then makes contact with the vehicle Z2. On the basis of the present position in each case of the vehicle end of the vehicle Z2, the vehicle Z1 is in each case specified a present braking target point ZP(Z2) or HP(Z2) up to which the vehicle Z1 then moves behind the vehicle Z2. The present braking target point ZP(Z2) is not a danger point and hence also a train headway point of the second type of train headway point ZFT.II as long as the vehicle Z2 is travelling in the direction of the track element S3—i.e. continues to move forward. As a result, the vehicle Z1 switches on its steep braking curve $BK1_A$.II in order to follow the vehicle Z2 quickly even if herein it would slip slightly over the braking target point ZP(Z2). However, as soon as the vehicle Z2 has come to a halt at the braking target point HP(Z3) behind the vehicle Z3, the present braking target point is a danger point for the vehicle Z1 and hence also a train headway point of the second type of train headway point ZFT.II. As a result, the vehicle Z1 then switches from its steep braking curve $BK1_A$.II to its flat braking curve $BK1_A$.I since it is not permitted to slip beyond the braking target point HP(Z2).

Figure 5:
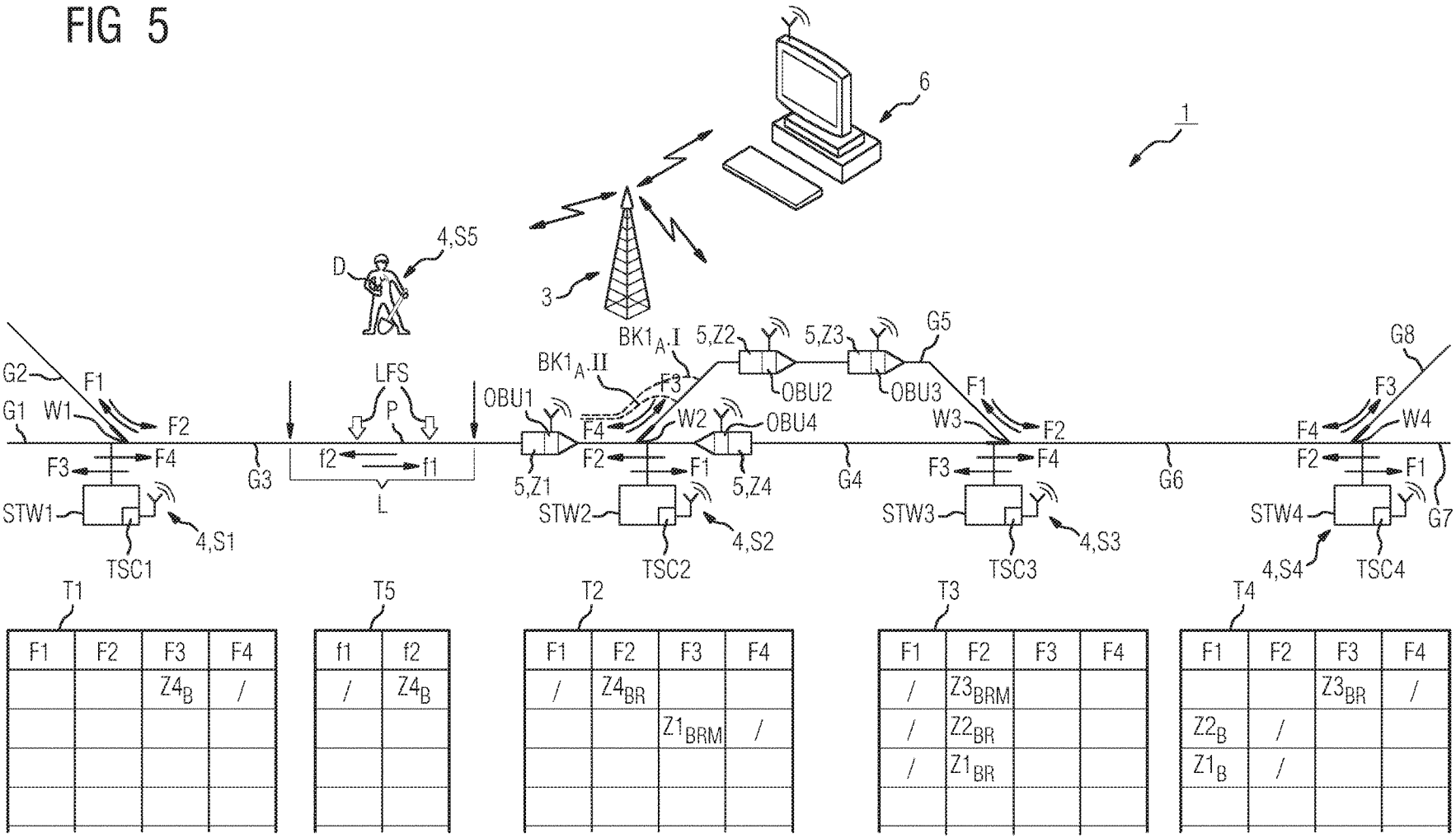

A train driver of the vehicle Z1, not shown here, has identified warping in the track bed at the position of the rail track section G3 shown in FIG. 5. Therefore, the driver outputs characteristic data for a speed restriction LFS including the point P via an interface of the vehicle control as dynamic driving-operation data to the vehicle control OBU1. The vehicle deposits its dynamic driving-operation data at least in the track element S2 lying in its direction of travel as soon as the manual entry is completed by storage. However, dynamic driving-operation data, for example in the form of slippery sections, can also be acquired by sensors of the respective vehicle and only released manually by the train driver, wherein then the respective vehicle also deposits its dynamic driving-operation data at least in the track element lying its direction of travel as soon as this is released. The deposition preferably takes place on the next communication with the respective track element lying in the direction of travel. Therefore, the vehicle Z1 deposits the characteristic data for the speed restriction at the time point at which it outputs its confirmation of passage to the track element S2.

According to FIG. 5, a gang R is already approaching the position P of the rail track section G3 in order to remove the warping in the track bed. For the protection of the gang, a gang leader is carrying the portable device D, which, in addition to the track element control TSC5, comprises the means for release MF5 and the means for the determination of its present position MO5. The portable device D can be used to integrate the track element 5 into the rail network, which, after integration, forms the working zone AZ for the protection of the gang. After activation, the track element control TSC5 specifies the present location of the working zone AZ in dependence on its present position and signs on with the track elements S1 and S2. The track element S1 notifies the track element S5 that it has entered its authorization as a route element for the vehicle Z4. In response thereto, the track element S5 also inputs its authorization for the vehicle Z4 as a route element. Thus, the track section G3 is temporarily divided by the track element S5.

Figure 6:
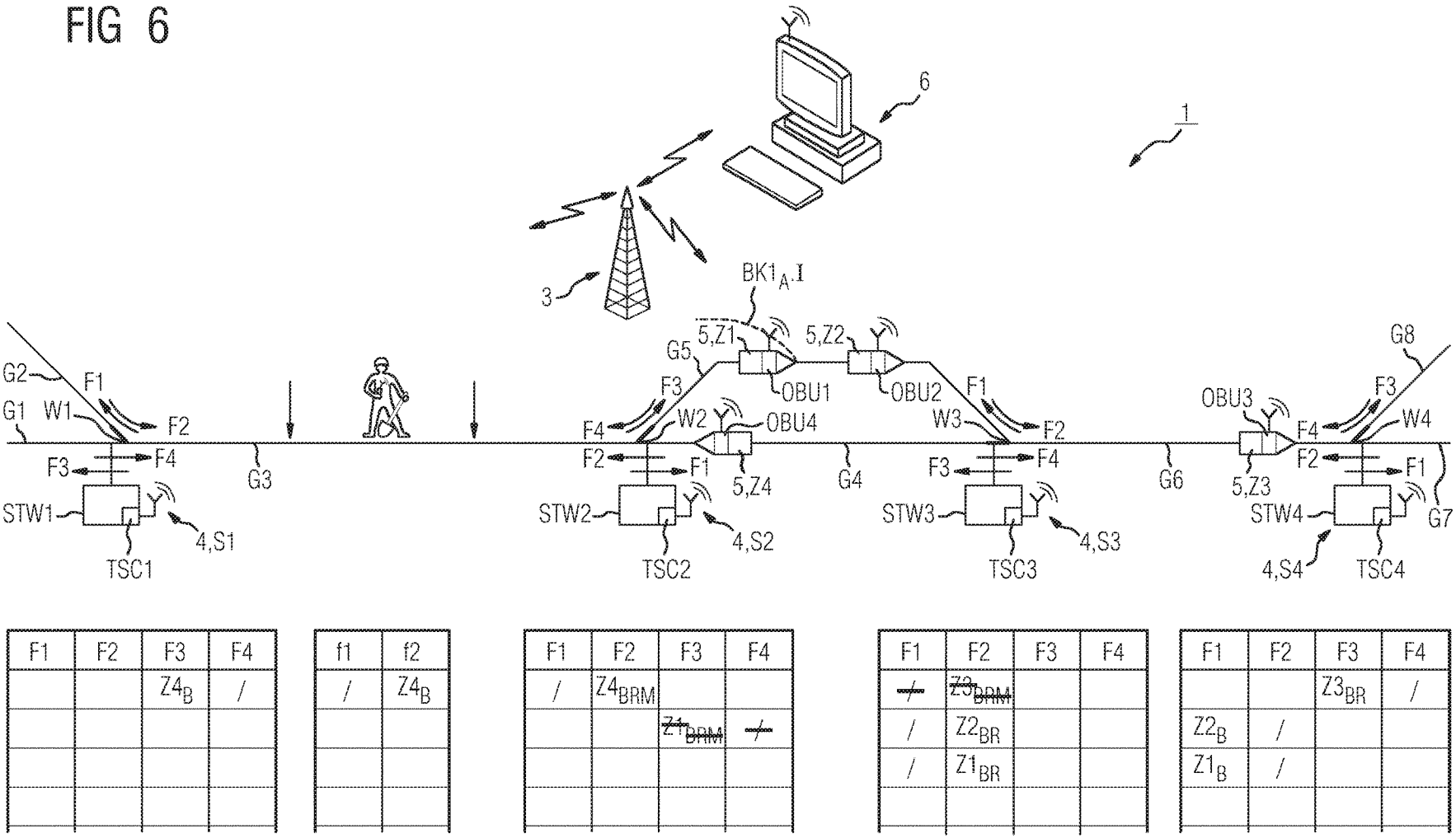

According to FIG. 6, the track element S2 has made its marking for the vehicle Z4 and the vehicle Z4 requests the registration of the track element S1. The track element S1 then informs the vehicle Z4 of the temporarily inserted track element S5, which forms the working zone AZ, and notifies it in particular of the communication address of the track element S5. The vehicle now requests the registration as a route element from the track element S5.

Figure 7:
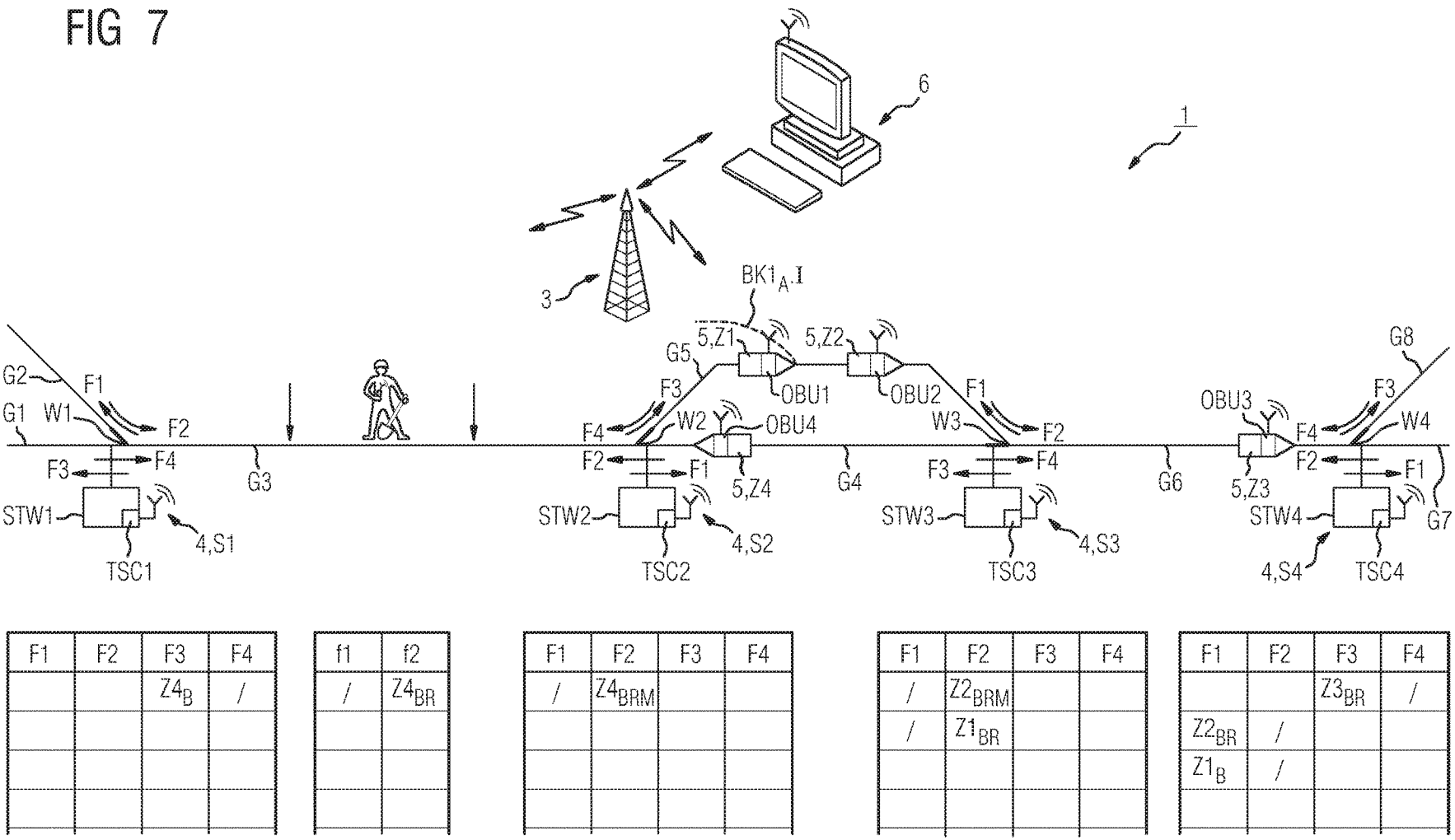

According to FIG. 7, the track element S5 makes its registration for the vehicle Z4 so that the vehicle Z4 can advance as far as the braking target point HP4(*re*).

Figure 8:
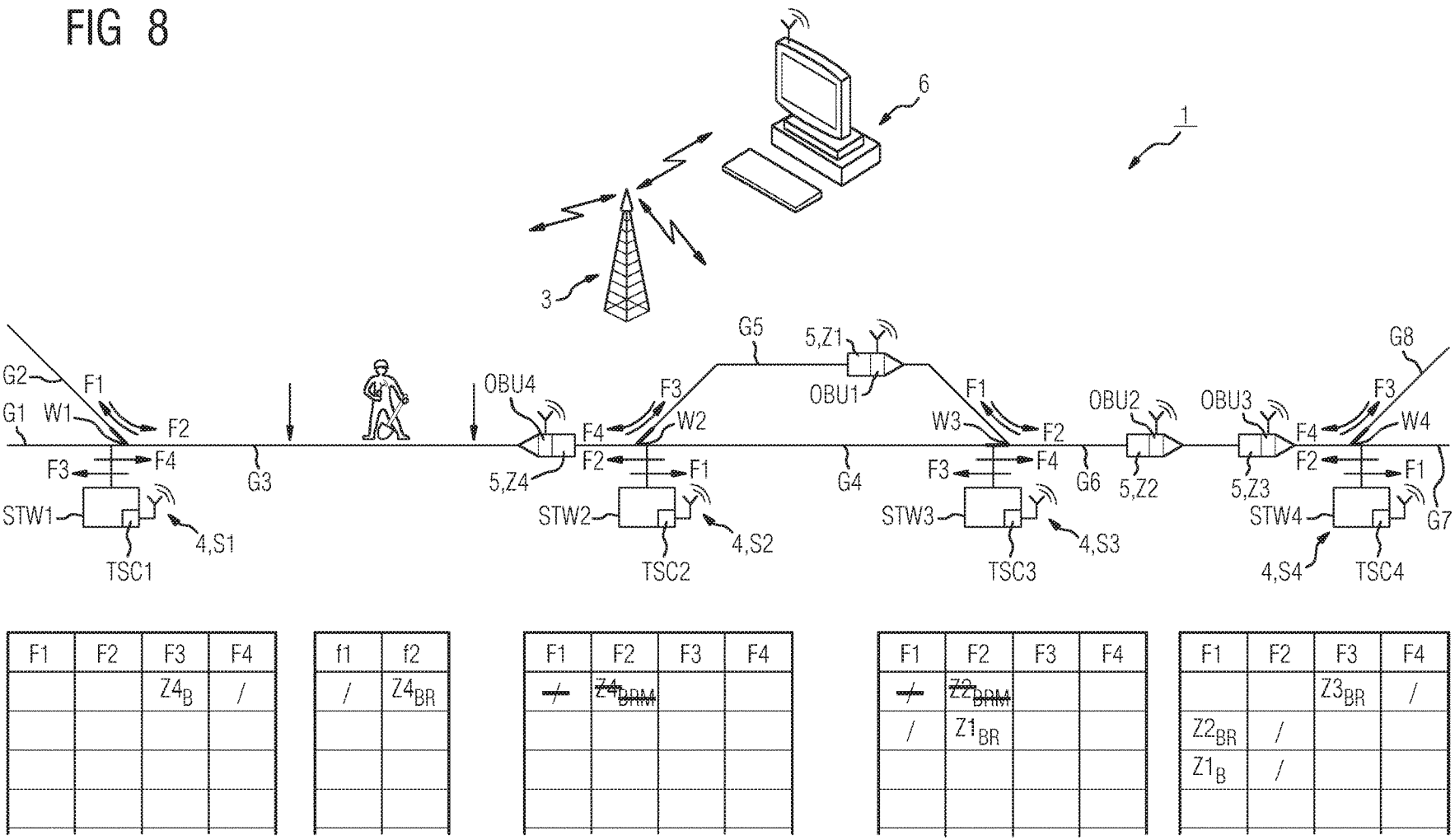

According to FIG. 8, the vehicle Z4 requests the marking of the track element S5. In response, the track element makes its marking, but does not output a marking confirmation to the vehicle Z4.

Initially, the device D indicates on a display and/or audibly that the vehicle Z4 wishes to pass through the working zone.

Figure 9:
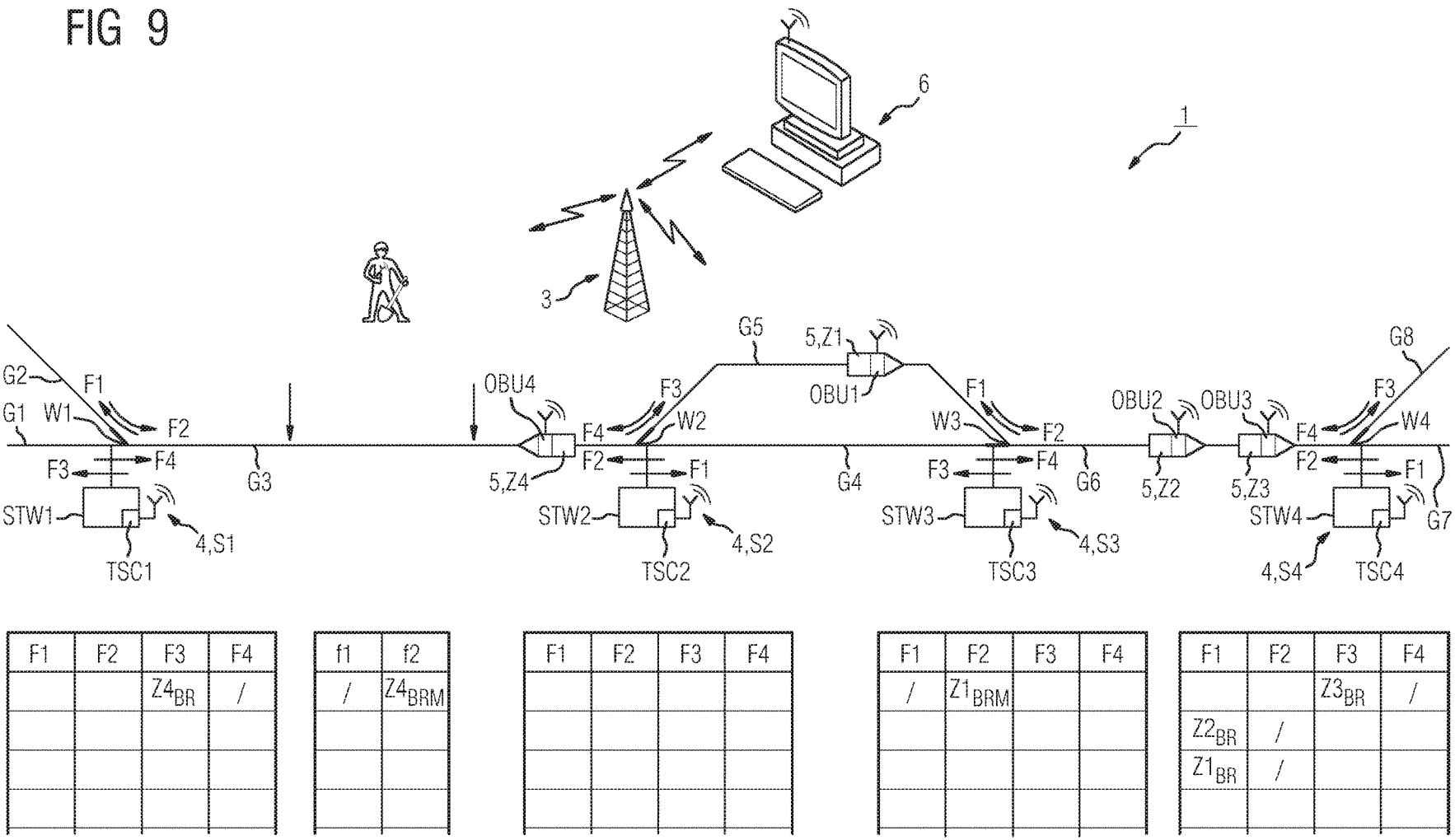

According to FIG. 9, the gang leader ensures that the entire gang leaves the danger area on the track and remains away therefrom and then inputs the assignment release Fm,5, where m=1 to r, via the means for release MF5 of the device D. Only when this assignment release Fm,5, where m=1 to r, has been input does the track element S5 output the marking confirmation $Q_M$4,5, wherein the marking confirmation $Q_M$4,5 forms the assignment confirmation. The vehicle Z4 requests the registration of the track element S1. The track element S1 makes this registration.

According to FIG. 10, the vehicle Z4 now advances as far as the braking target point HP1(Sp). The vehicle Z4 outputs a corresponding confirmation of passage to the track element S5, which then deletes the storage entry $Z4_{BRM}$ and the blocking entry "/" on the adjacent left—i.e. withdraws or cancels its authorization, registration and marking for the vehicle Z4. The gang can then return to working in the danger area.

The invention claimed is:

1. A protection method for a rail network that is divided by track elements into track sections and on which vehicles can travel, the method comprising:

specifying different types of headway points; and providing, by the vehicles, different braking curves of a same type of braking curve, and assigning each of the different braking curves of the same type of braking curve for a respective vehicle to a respective one of the different types of headway points;

wherein at least one braking target point, which is a danger point, forms a headway point of a first type of headway points, and a first braking curve of the respective vehicle is assigned to the at least one braking target point, which is a danger point, and the first braking curve of the respective vehicle does not allow the respective vehicle to slip over the at least one braking target point;

wherein at least one further braking target point, which is not a danger point, forms a headway point of a second type of headway points, a second braking curve of the respective vehicle is assigned to the at least one further braking target point, which is not a danger point, and the second braking curve of the respective vehicle allows the respective vehicle to slip over the at least one further braking target point; and wherein the different braking curves of the same type of braking curve include the first braking curve and the second braking curve.

2. The protection method according to claim 1, which comprises specifying a track element being a switching device as a braking target point, which is a danger point.

3. The protection method according to claim 1, which comprises specifying a track element being a bumper as a braking target point, which is a danger point.

4. The protection method according to claim 1, which comprises specifying a braking target point, which is a danger point, with reference to a current position of a vehicle end of a stationary vehicle in a track section for a following vehicle.

5. The protection method according to claim 1, which comprises specifying a track element being a spring-loaded switching device as a further braking target point, which is not a danger point.

6. The protection method according to claim 1, which comprises specifying a current position of a vehicle end of a moving vehicle in a track section as a further braking target point, which is not a danger point, for a following vehicle.

7. The protection method according to claim 1, which comprises specifying a track element embodied as a fictitious double entry/exit element as a braking target point, which is not a danger point.

* * * * *